US005917118A

United States Patent [19]

Kosann et al.

[11] Patent Number: 5,917,118

[45] Date of Patent: Jun. 29, 1999

[54] APPARATUS AND PROCESS FOR CONTINUOUS DYEING OF FIBER

[75] Inventors: Sidney H. Kosann, Norfolk, Conn.; Neil Wright, Cherryville, N.C.

[73] Assignee: Shelby Yarn Company, Shelby, N.C.

[21] Appl. No.: 08/994,687

[22] Filed: Dec. 19, 1997

[51] Int. Cl.[6] ..... D06B 3/02

[52] U.S. Cl. ..... 8/149.1; 8/149.3; 8/151; 68/5 D; 68/9; 68/22 B

[58] Field of Search ..... 8/149.1, 149.3, 8/151; 68/5 D, 5 E, 9, 22 R

[56] References Cited

U.S. PATENT DOCUMENTS

| | | | |
|---|---|---|---|
| 1,432,318 | 10/1922 | Brandwood et al. | 8/149.1 X |
| 3,056,275 | 10/1962 | Williams | 68/5 D X |
| 3,529,926 | 9/1970 | Fleissner | 8/149.3 X |
| 3,660,014 | 5/1972 | Ohya | 8/149.1 |
| 4,158,297 | 6/1979 | Winch | 68/22 R |
| 4,199,966 | 4/1980 | Winch | 68/22 R |
| 4,213,218 | 7/1980 | Winch | 8/151 |
| 4,231,129 | 11/1980 | Winch | 8/149.1 |
| 4,242,090 | 12/1980 | von der Eltz | 8/532 |
| 4,425,842 | 1/1984 | Winch et al. | 100/37 |
| 4,434,633 | 3/1984 | Winch et al. | 68/267 |
| 4,462,130 | 7/1984 | Burnthall | 8/149.1 |
| 4,944,070 | 7/1990 | Girard et al. | 8/149.1 X |

*Primary Examiner*—Philip R. Coe
*Attorney, Agent, or Firm*—David P. Gordon; David S. Jacobson; Thomas A. Gallagher

[57] ABSTRACT

An apparatus and method for the dyeing raw cotton fibers in a continuous wet process includes cleaning raw cotton fibers, aligning and forming a cotton batt, and then providing the cotton batt to a continuous wet process dye system. The continuous wet process system includes a dye applicator, a steamer, a first rinser, an oxidizing applicator, a second rinser, and a finish rinser. The batt is conveyed at ambient temperature and pressure along a series of conveyor belts through the system, first being immersed in the dye solution in the dye applicator. The dye solution is an aqueous solution of dye, alkali, penetrant, and a solubilizer. After a short immersion in the dye solution, the batt is conveyed to a set of squeeze rollers which squeeze excess dye solution from the cotton. The cotton is then moved through a steamer to fix the dye, through a first rinser, and then through a second set of squeeze rollers to remove water. The oxidation process which occurs in the oxidizing applicator further fixes the dye. The batt is then moved through a third set of squeeze rollers to remove remaining oxidizing chemicals and conveyed to the second rinser where it is subjected to a heated soap spray. The cotton batt is then sent through a fourth set of squeeze rollers. Finally, the cotton is conveyed through the final water rinse, conveyed through squeeze rollers, and then dried preparatory to baling.

10 Claims, 3 Drawing Sheets

APPARATUS AND PROCESS FOR CONTINUOUS DYEING OF FIBER

BACKGROUND OF THE INVENTION

1. Field of the Invention

This invention relates broadly to a process for dyeing fibers. More particularly, this invention relates to a continuous process for dyeing raw cotton fibers.

2. State of the Art

A bale of cotton generally comprises non-cohesive clumps of raw cotton fibers in varying sizes and thicknesses. Due to the difficulty in working with the non-cohesive clumps, raw cotton fibers are dyed in a batch process. In the batch process, raw cotton fibers are compressed into a perforated cylinder wrapped in a wire basket having a handling hook at the top. A crane lifts the wire basket by the hook and lowers the cotton batch into a pressured dye kettle where the cotton is immersed in a dye solution. The cotton, which is now in the pressurized kettle, is dyed under pressure for a period of time, e.g., four hours, allowing the dye to be fully absorbed into the cotton. After dyeing, the cotton batch is rinsed to take out excess dye. Afterward, a crane is operated to lift and move the cotton in the basket to a centrifical extractor which extracts or otherwise removes excess water from the cotton. The dyed cotton fiber, also referred to as stock dyed cotton, is then dried with heat and air before entering into the spinning process.

Because raw cotton fibers are dyed in a batch process, the color of the dyed cotton will undesirably vary from batch to batch even where the dye solution provided to each batch is closely controlled. A continuous process with an "endless" dye lot can provide a better consistency of color. However, while it has been long known in the art that a continuous dyeing process would be desirable, to date, no commercially feasible solutions have been provided for such a continuous process.

It is known to dye fabrics (as opposed to fibers) in a continuous dyeing process rather than in a batch process. In the continuous fabric dyeing process, a roll of uniformly flat, continuous, knit or woven fabric is held taught and fed between dye pressure rollers which apply dye to the fabric. However, because raw cotton is neither flat, uniform in thickness, or continuous, it is not possible to adopt the continuous method of dyeing fabrics for use in dyeing raw cotton fibers.

SUMMARY OF THE INVENTION

It is therefore an object of the invention to provide an apparatus and method for the continuous dyeing of fibrous materials.

It is another object of the invention to provide an apparatus and method for the continuous dyeing of raw cotton fibers.

It is a further object of the invention to provide an apparatus and method for the continuous dyeing of fibers at substantially atmospheric pressure and temperature.

It is an additional object of the invention to provide an apparatus and method for the continuous dyeing of fibrous material which is time and labor efficient and which will produce dye lots of continuous color in theoretically unlimited quantities.

It is also an object of the invention to provide an apparatus and method for the continuous dyeing of fibrous material with sulfur, vat, direct, and reactive dyes.

In accord with these objects, which will be discussed in detail below, an apparatus and method for the dyeing of fibers, and raw cotton fibers in particular, in a continuous wet process is provided. The apparatus includes a batt former which forms fiber batts and a continuous wet process dyeing system. The continuous wet process dyeing system includes a dye bath for dyeing the fiber batt, a steamer and oxidizing solution applicator for fixing the dye, rinsers for rinsing excess dye solution and oxidizing agent from the fiber batt, and conveyors for conveying the batts through the dye bath, steamer, oxidizing solution applicator, and rinsers. The dye bath preferably comprises an aqueous solution including the dye, an alkali (e.g., sodium hydroxide or potassium hydroxide), a penetrant, and, depending upon the type of dye utilized, a solubilizer.

According to a preferred embodiment, the batt is transported at ambient temperature and pressure into the dye applicator, which contains the aqueous dye solution of a sulphur, direct, reactive, or vat dye, plus an alkali such as caustic soda, and a penetrant. After a preferably relatively short immersion through the dye solution, e.g., approximately thirty seconds to one minute, the batt is transported from the dye applicator through a first set of squeeze rollers to squeeze excess dye solution from the cotton. The cotton is then moved through the steamer to fix the dye. After exiting the steamer, the cotton batt is transported through a first rinser and then through a second set of squeeze rollers to remove excess water which may otherwise weaken the subsequent oxidizing process. The oxidation process which occurs in the oxidizing applicator further fixes the dye by returning the dye to a chemically insoluble state. The oxidizing applicator also includes rinsers to remove the oxidizing chemicals. The batt continues to move through a third set of squeeze rollers to remove remaining oxidizing chemicals and is conveyed to a second rinser where it is subjected to a heated soap spray which removes loose dye and cleans the cotton. The cotton batt is then sent through a fourth set of squeeze rollers where liquid is again squeezed from the batt. Finally, the cotton is conveyed through a final rinser in which a series of hot and cold water rinsers removes excess chemicals from the cotton. Upon exiting the finish rinser, the cotton is passed through a final set of squeeze rollers to remove water and assist in drying the cotton batt. After the wet process, the batt is conveyed over and under a series of drying cylinders to pre-dry the cotton, and then through a hot air dryer for the final drying. After the cotton batt is dry, the cotton fibers are pneumatically distributed to a bale press and baled preparatory to going into the spinning process.

It will be appreciated that the apparatus and process of the invention enable the continuous dyeing of batts of raw cotton fibers at atmospheric temperature and pressure. As such, a large quantity of cotton can be dyed in one color in a relatively short period of time, as compared to the longer batch dyeing process which produces dye lots of varying shades from lot to lot. In addition, certain relatively expensive pieces of equipment required to batch dye cotton, e.g., cranes and large pressurized vats, are not required by the apparatus and method of the invention. Moreover, minimal human intervention is required during the wet dye process.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
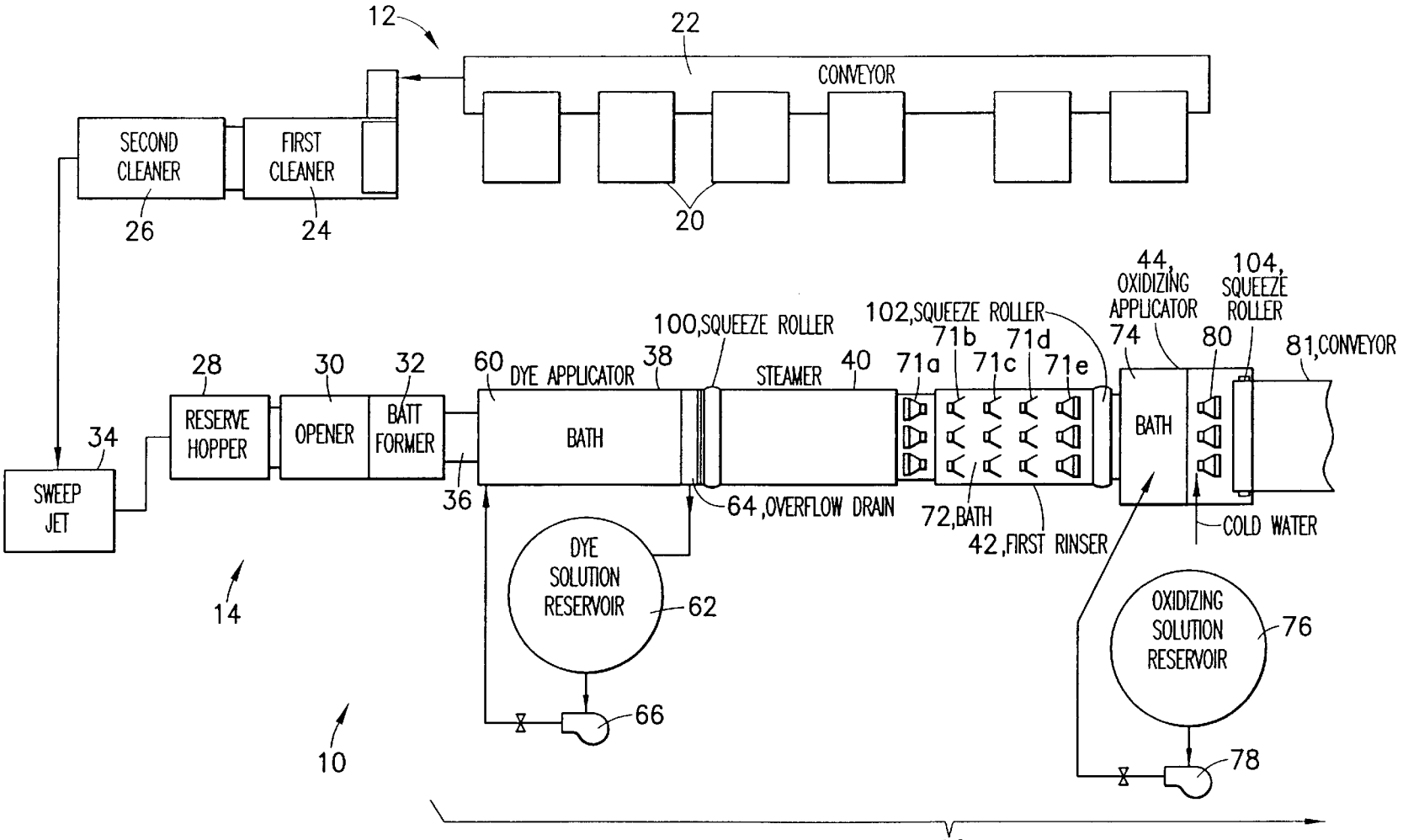
FIGS. 1 and 2 together form a top schematic view of an apparatus for the continuous dyeing of fiber according to the invention.
Figure 2:
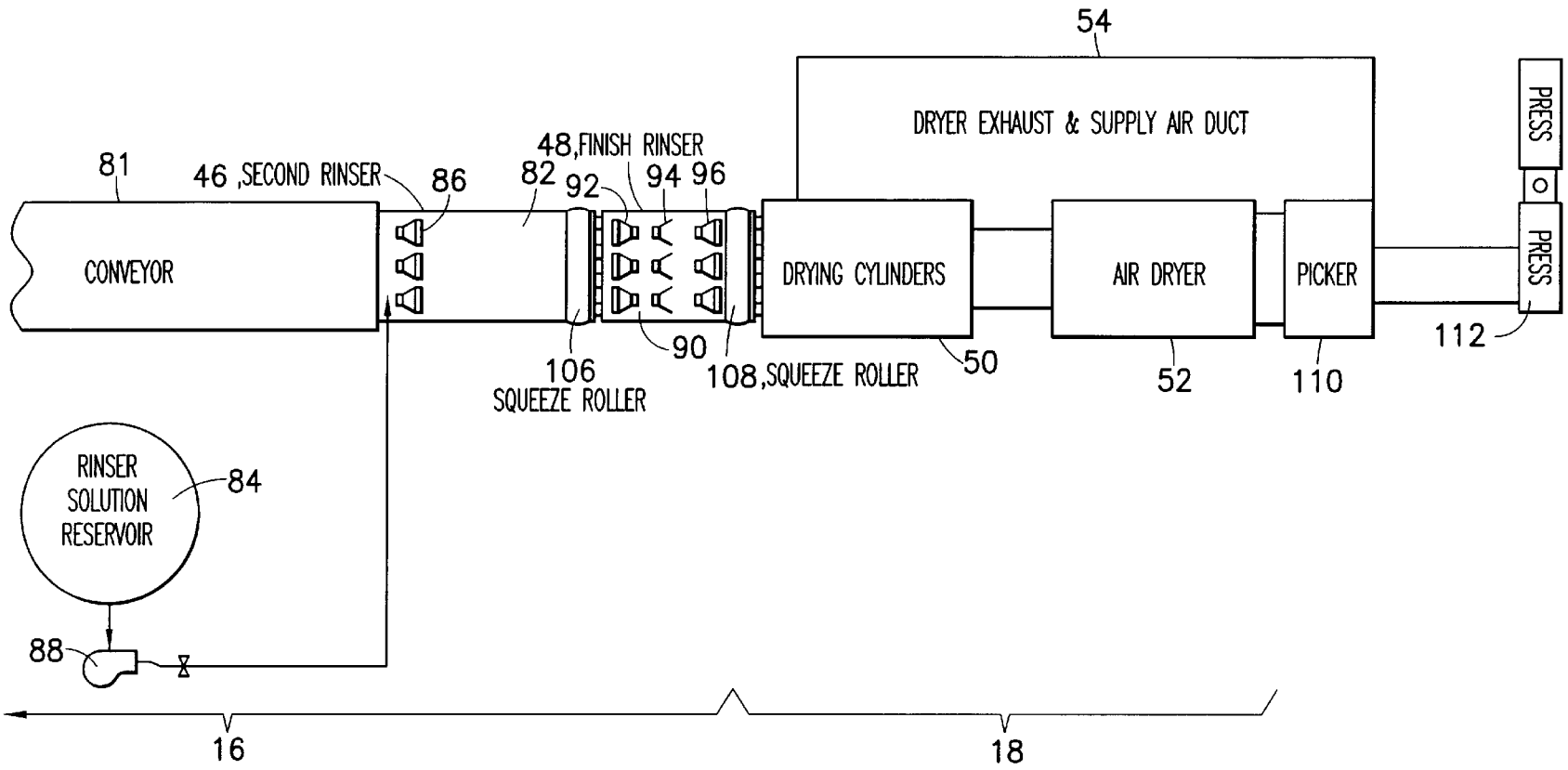

Turning now to FIGS. 1 and 2, the apparatus 10 for a continuous fiber dyeing process according to the invention is shown. The apparatus 10 includes a fiber feed and cleaning system 12, a fiber preparation system 14, a wet dye processing system 16, and a drying system 18. The fiber feed and clean system 12 generally includes opening hoppers 20 feeding a conveyor 22, a first cleaner 24 at the end of the conveyor 22, a second cleaner 26, and a sweep jet cleaner 34. The fiber preparation system 14 generally includes, in order, a reserve hopper 28, an opener 30, and a batt former 32. The preferably continuous batt formed by the batt former 32 is a very loosely compacted cotton, approximately four inches thick, and forty inches wide. The wet dye processing system 16 generally includes, in order, a dye applicator 38, a steamer 40, a first rinser 42, an oxidizing applicator 44, a second rinser 46, and a finish rinser 48. The drying system 18 generally includes a drying cylinder system 50, an air dryer system 52, and an exhaust system 54.

Turning now to FIGS. 1 through 4, more particularly with respect to the wet dye processing system 16, the dye applicator 38 includes a bath 60 provided with dye solution, a dual-belt conveyor system 61 extending through the bath 60, a dye solution reservoir 62, an overflow drain 64 feeding excess dye solution from the bath 60 to the reservoir 62, a pump 66 which supplies required dye solution to the bath 60 from the reservoir 62. Each belt 61*a,* 61*b* of the dual-belt conveyor system has a conveying surface which faces the conveying surface of the other belt and moves through the bath toward the steamer 40. All belts are perforated top and bottom allowing penetration of the dye solution and other solutions utilized in the process while holding the cotton batt together. The steamer 40 includes upper, middle, and lower conveyor belts 68, 69, 70, with the upper and lower belts 68, 70 moving in the direction of the first rinser 42 and the middle belt 69 moving in the direction of the dye applicator 38. The first rinser 42 includes five sets of cold water sprayers 71*a*–71*e,* a drainage bath 72, and a conveyor 73. The oxidizing applicator 44 includes a preferably heated bath 74 (preferably heated at 120° F.), a conveyor 75 moving through the heated bath 74, a preferably heated oxidizing solution reservoir 76 (also preferably heated at 120° F.), a pump 78 which supplies oxidizing solution from the reservoir 76 to the heated bath 74, and a set of cold water sprayers 80. Optionally, a conveyor 81 is provided between the oxidizing applicator 44 and the second rinser 46; otherwise, the second rinser 46 abuts the oxidizing applicator 44. The second rinser 46 includes a drainage bin 82, a conveyor 83 moving through the drainage bin 82, a preferably heated (180° F.–190° F.) rinser solution reservoir 84, a set of rinser solution sprayers 86, and a pump 88 to pump heated rinser solution from the reservoir 84 to the sprayers 86. The finish rinser 48 includes a drainage bin 90, a conveyor 91 moving through the drainage bin 90, a set of hot water sprayers 92 which can pump water at preferably 150° F., and preferably two sets of cold water sprayers 94, 96.

According to a preferred embodiment of the invention, a first set of squeeze rollers 100 is provided between the dye applicator 38 and the steamer 40; a second set of squeeze rollers 102 is provided between the rinser 42 and the oxidizing applicator 44; a third set of squeeze rollers 104 is provided after the oxidizing applicator 44; a fourth set of squeeze rollers 106 is provided between the second rinser 46 and the finish rinser 48; and a fifth set of squeeze rollers 108 is provided between the finish rinser and the drying cylinders 50 of the drying system 18.

The dye solution in the dye applicator 38 generally includes one of a sulfur dye, a direct pretreat dye, a direct after-treat dye, a reactive dye, and a vat dye and further comprises an alkali (e.g., caustic soda) enabling the dye to adhere to cotton fibers, a penetrant (wetting agent), and, in the case of a vat dye or sulfur dye, a solubilizer such as sodium hydrosulfite ("hydro"), all provided in water. According to a preferred embodiment of the invention, the caustic soda is preferably provided in a concentration of five ounces per gallon of water, the sodium hydrosulfite is preferably provided in a concentration of four ounces per gallon of water, the penetrant is preferably provided in a concentration of one half ounce per gallon of water, and the dye is provided in an amount determined to provide the required depth of color for a particular application. By way of example only, a sulfur dye may have a concentration of twenty-two percent in solution and a vat dye may have a concentration of seven percent in solution. Also according to the preferred embodiment, the caustic soda is sodium hydroxide or potassium hydroxide, and the penetrant is Dypenol™ available from Chemway, Skynol™ available from Skyland Chemical, or Merpol™ available from Dupont.

The oxidizing solution generally includes an acid such as acetic acid to neutralize the pH of the dye solution absorbed by the cotton, and a chemical such as hydrogen peroxide or sodium dichromate to cause the dye in the dye solution to return to an insoluble state. According to a preferred oxidizing solution, a 300 gallon mix of oxidizing solution comprises thirty pounds of 50% hydrogen peroxide and thirty pounds of 84% acetic acid.

The rinse solution provided in the second rinser 46 is generally a soap, and preferably includes one ounce of a liquid soap and one quarter ounce soda ash per gallon of water.

According to the process of the invention, bales of raw cotton fibers are provided into the opening hoppers 20 of the fiber feed and clean system 12. Conveyor belts (not shown) within the opening hoppers 20 move the raw cotton from the opening hoppers onto the conveyor 22, which conveys the cotton to the first cleaner 24. The first cleaner 24 removes coarse material (e.g., stems and non-cotton particles) from the cotton. The cotton is then pneumatically pulled through to the second cleaner 26 which removes smaller debris material. The cotton next enters the sweep jet 34 which removes finer debris material and breaks up the cotton into a very loose form. The sweep jet 34 feeds the cotton to the reserve hopper 28 of the fiber preparation system 14. The opener 30 evenly distributes cotton fibers from the reserve hopper 38 into the batt former 32 which, preferably continuously, forms the cotton fibers into a cotton batt (a non-uniform sheet of loosely compacted or matted cotton).

Figure 3:
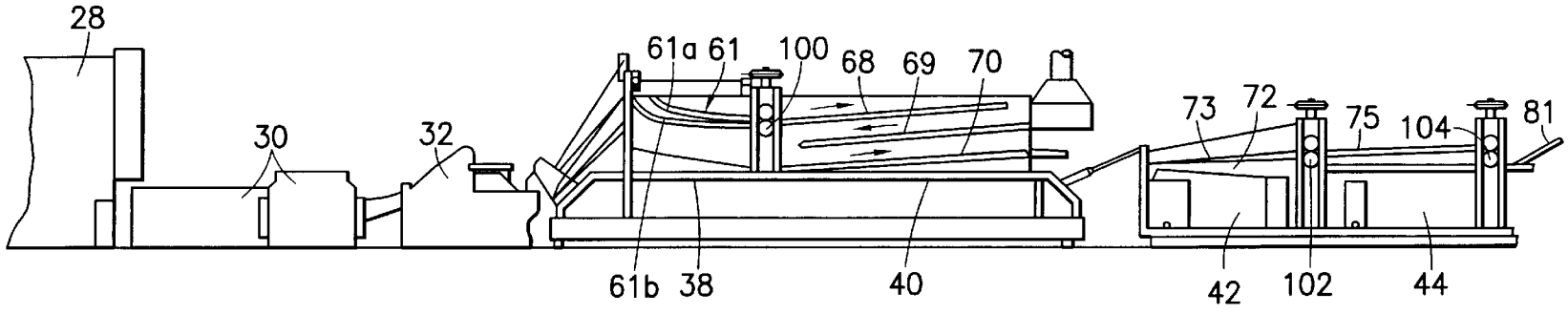
FIGS. 3 and 4 together form a broken partial side view of the apparatus for the continuous dyeing of fiber according to the invention.

Referring now to FIGS. 1 and 3, the batt is doffed and provided, preferably at ambient temperature and pressure, between the conveying surface of the conveyor belts 61*a,* 61*b* of the dual-belt system 61 of the dye applicator 38. The dual-belt system 61 transports the cotton batt through the bath 60 of the dye applicator 38 and holds the batt together as it is immersed in the dye solution. The batt is transported on the dual-belt system 61 at preferably eight to sixteen feet per minute, such that the batt is immersed in the dye solution for approximately thirty to sixty seconds. As discussed above, the dye solution is circulated from the bath 60 through the overflow drain 64 to the dye solution reservoir 62, and fed back to the bath by the pump 66. The dye solution reservoir 62 is preferably a very large reservoir which can be continuously or periodically replenished in a manner which causes the dye provided to the dye applicator to maintain a consistent color. As the batt exits the dye applicator 38, the batt is transported through the first set of squeeze rollers 100 to squeeze excess dye solution from the batt. The batt is then moved through the steamer 40, first along the upper conveyor 68, then dropped onto middle conveyor 69 and moved back through the length of the steamer, and then dropped again onto the lower conveyor 70 to again move the batt through the steamer. As a result, the batt is subject to raw steam for preferably forty-five seconds to two minutes. The raw steam provides initial fixing of the dye to the cotton fibers of the batt.

After exiting the steamer 40, the cotton batt is provided to the conveyor 73 of the first rinser 42. The cold water sprayers 71*a*–71*e* of the first rinser 42 rinse the batt to remove excess dye solution from the batt. Upon exiting the first rinser 42, the batt is transported through the second set of rollers 102 to remove excess water which may otherwise weaken the subsequent oxidizing process. Next, the batt is provided to the conveyor 75 of the oxidizing applicator 44 to move the batt therethrough. The oxidizing solution in the oxidizing applicator 44 sets the dye color into the cotton fibers by returning the dye to a chemically insoluble state. In the oxidizing applicator 44, the batt is subjected to the oxidizing solution in the heated bath 74. As discussed above, oxidizing solution is provided from the oxidizing solution reservoir 76 to the bath 74 by the pump 78. As the batt exits the oxidizing applicator 44, the batt is rinsed by preferably cold water from the cold water sprayers 80 to remove the oxidizing chemicals. The batt is then transported through the third set of rollers 106 to additionally remove oxidizing chemicals from the batt. The cotton batt may then be moved along a conveyor 81 to the second rinser 46 or provided directly to the second rinser 46 from the oxidizing applicator 44.

Figure 4:
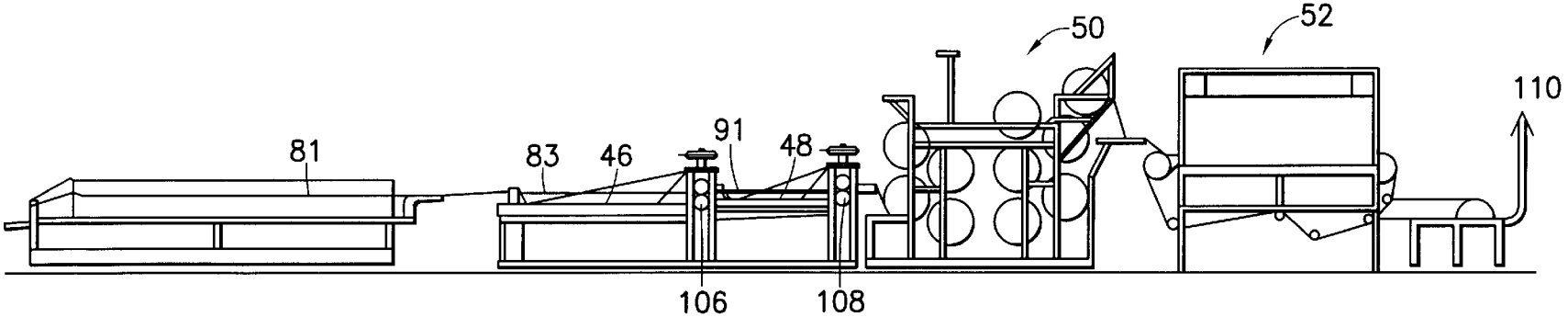

Turning now to FIGS. 2 and 4, the batt leaves the conveyor 81 and is provided to the conveyor 83 of the second rinser 46. As the batt is moved along conveyor 83, the rinser solution sprayer 86 subjects the batt to a heated soap solution spray rinse to further remove any loose dye and clean the batt. The batt is then sent through the fourth set of rollers 106 where liquid is again squeezed from the batt. Finally, the batt is transported on the conveyor 91 through the drainage bin 90 of the final rinser 48 and the hot and cold water sprays 92, 94, 96 remove excess remaining chemicals from the batt. Upon exiting the finish rinser, the batt is passed through the fifth set of squeeze rollers 108 to remove water and assist in drying the cotton batt.

After the wet process, the batt enters the drying system, and in particular, is conveyed over and under a series of drying cylinders 50 to pre-dry the cotton, and then through a hot air dryer 52 for final drying. The exhaust system 54 removes hot air, steam, and fine cotton particulate matter from the hot air dryer 52. After the cotton batt is dry, the cotton fibers are sent to a picker 110 to break up the batt and return the cotton to a loose fibrous form, and finally to a press 112 to bale the loose fibrous cotton. The dyed baled cotton is thereby made suitable for spinning into dyed yarn.

There have been described and illustrated herein an apparatus for the continuous dye processing of raw cotton fibers and a method of continuously dyeing raw cotton fibers. While a particular embodiment of the invention has been described, it is not intended that the invention be limited thereto, as it is intended that the invention be as broad in scope as the art will allow and that the specification be read likewise. Thus, while a particular dye solution, oxidizing solution, and soap solution have been disclosed, it will be appreciated that other dye solutions, oxidizing solutions, and soap solutions may be used as well, as long they perform the same function in substantially the same way. In addition, while sodium hydrosulfite has been disclosed as part of the preferred dye solution, it will be appreciated that sodium hydrosulfite is preferably used with vat dyes and sulfur dyes and may not need to be used with direct pretreat and after-treat dyes and reactive dyes. Also, while preferred concentrations for the various constituents of the dye solution, the oxidizing solution, and the soap solution have been disclosed, it will be appreciated that the constituents of the respective solutions may be provided in other concentrations. In addition, while certain preferred caustic sodas (sodium hydroxide and potassium hydroxide) have been disclosed with respect to the dye solution, it will be appreciated that other caustic sodas may be used. Furthermore, while particular preferred temperatures have been disclosed with respect to the oxidation step, the second rinsing step, and the finish rinsing step, it will be understood that ranges of temperatures can be used. By way of example, and not to be construed as a limitation, with respect to the oxidation step, the preferable range is 108° F. to 132° F.; with respect to the second rinsing step, the preferable range is 170° F. to 200° F.; with respect to the finishing rinse step, the preferable range is 120° F. to 200° F. Other ranges of temperatures may also be used as long as the temperatures permit the satisfactory performance of the respective step. Also, while particular dwell times have been disclosed, e.g., with respect to length of the time the batt is immersed in dye solution, it will be appreciated that other dwell times may be used. Furthermore, while the dyeing process has been described with respect to dyeing raw cotton fibers, it will be appreciated that other fibers may be dyed via the method and apparatus of the invention. It will therefore be appreciated by those skilled in the art that yet other modifications could be made to the provided invention without deviating from its spirit and scope as so claimed.

What is claimed is:

1. A method of continuous wet dye processing of fibrous material, comprising:

a) continuously providing fibrous material in batt form;

b) immersibly transporting the fibrous material through a dye solution containing a dye;

c) steaming the fibrous material to initially fix said dye to said batt;

d) rinsing the fibrous material a first time to remove excess dye;

e) lowering the pH of said dye in the fibrous material to cause said dye to become insoluble; and f) rinsing the fibrous material a second time.

2. A method according to claim 1, wherein:

said fibrous material is raw cotton fiber.

3. A method according to claim 2, wherein:

said immersably transporting occurs at ambient pressure and temperature.

4. A method according to claim 2, wherein:

said immersably transporting requires approximately thirty seconds to two minutes.

5. A method according to claim 2, wherein:

said lowering the pH includes transporting the fibrous material through an oxidizing solution.

6. A method according to claim 5, wherein:

said oxidizing solution is heated to approximately 108° F. to 132° F.

7. A method according to claim 2, wherein:

said rinsing a first time includes spray rinsing with cold water and said rinsing a second time comprises rinsing with a soap solution.

8. A method according to claim 7, wherein:

said soap solution is heated to approximately 170° F. to 200° F., and said rinsing a second time further comprises spray rinsing with water heated to approximately 120° F. to 200° F.

9. A method according to claim 2, further comprising:

g) first squeezing the fibrous material after the fibrous material is immersably transported through said dye solution;

h) second squeezing the fibrous material after said rinsing a first time the fibrous material;

i) third squeezing the fibrous material after said lowering the pH of said dye in the fibrous material;

j) fourth squeezing the fibrous material after said rinsing a second time the fibrous material; and k) drying the fibrous material.

10. A method according for continuous dye processing raw cotton fibers, comprising:

a) continuously providing the raw cotton fibers in batt form;

b) immersably transporting the raw cotton fibers on a first conveyor through a bath of a dye solution containing a dye;

c) transporting the raw cotton fibers on a second conveyor through a steamer to initially fix said dye to the raw cotton fibers;

d) transporting the raw cotton fibers on a third conveyor through a first rinser to remove excess dye solution;

e) transporting the raw cotton fibers on a fourth conveyor through an oxidizing solution to insolubilize said dye; and f) transporting the raw cotton fibers on a fifth conveyor through a second rinsing means to remove excess oxidizing solution.

* * * * *